US007246559B2

(12) United States Patent
Stromberg

(10) Patent No.: US 7,246,559 B2
(45) Date of Patent: Jul. 24, 2007

(54) ELEVATED BUS RAPID TRANSIT SYSTEM

(75) Inventor: Ronald E. Stromberg, Vancouver (CA)

(73) Assignee: Sky Trolley Inc., Vancouver BC (CA)

( * ) Notice: Subject to any disclaimer, the term of this patent is extended or adjusted under 35 U.S.C. 154(b) by 0 days.

(21) Appl. No.: 11/075,356

(22) Filed: Mar. 7, 2005

(65) Prior Publication Data

US 2006/0196385 A1 Sep. 7, 2006

(51) Int. Cl.
*B61B 12/04* (2006.01)
*B61D 47/00* (2006.01)

(52) U.S. Cl. ..... 104/124; 105/425

(58) Field of Classification Search ..... 104/124–127; 105/425

See application file for complete search history.

(56) References Cited

U.S. PATENT DOCUMENTS 3,457,876 A 7/1969 Holden
3,861,315 A 1/1975 Rypinski
3,890,904 A 6/1975 Edwards
4,098,036 A * 7/1978 Spoler et al. ..... 52/16
4,111,130 A * 9/1978 Rodot ..... 104/28
4,394,837 A 7/1983 Edwards
4,690,064 A 9/1987 Owen
5,231,931 A * 8/1993 Sauvageot ..... 104/124
5,372,072 A 12/1994 Hamy
5,456,183 A 10/1995 Geldbaugh
2005/0092831 A1* 5/2005 Sandoval et al. ..... 235/382

* cited by examiner

*Primary Examiner*—S. Joseph Morano
*Assistant Examiner*—Robert J. McCarry, Jr.
(74) *Attorney, Agent, or Firm*—Christie, Parker & Hale, LLP

(57) ABSTRACT

An elevated public transit bus system that increases the passenger capacity and decreases the passenger trip time of a fixed route bus service traveling in traffic on a city street to provide a high capacity rapid transit system. The high capacity buses are suspended above the motor vehicle traffic lanes by a support structure constructed in the lane adjacent to the public sidewalk. The propulsion system of the electrically powered buses run in a box beam from which the transit passenger cabins are suspended. The beams guide the buses along the existing fixed route service that is being upgraded to the carrying capacity of an elevated rail rapid transit system. The bus stops or lift stations of the elevated buses for passenger pick up and drop off is also constructed in the road lane next to the sidewalk. The lift stations house an enclosed movable platform that lifts passengers from sidewalk level to the floor level of the suspended bus. The high capacity rapid bus system makes efficient use of city streets by significantly increasing the capacity of persons per lane per hour use over that of the private vehicle. This public transportation enhancement reduces traffic congestion, energy consumption, and air pollution by making bus service more attractive, and by increasing the capacity of the street to carry more transit users without taking away business dependant road parking spaces or public sidewalk space.

15 Claims, 7 Drawing Sheets

ELEVATED BUS RAPID TRANSIT SYSTEM

FIELD OF THE INVENTION

This invention relates to the public transportation urban transit industry and specifically to a city rapid bus system capable of attaining a higher hourly passenger capacity and which is similar to elevated urban rail rapid transit systems.

BACKGROUND OF THE INVENTION

Over the past three decades public transit bus systems have been losing market share of commuter trips to the private motor vehicle, which in turn contributes to traffic congestion, air pollution, and energy consumption in large urban areas.

In order to make bus service more efficient and attractive many cities have reserved the motor vehicle lane of a street adjacent to the pedestrian walk (sidewalk) exclusively for buses in an express bus system. This lane is often referred to as the curb lane, and is used as a bus priority lane in the morning and evening rush hours. During the remainder of the day, the lane may be open to all traffic or reserved as parking lane for private motor vehicles. However, this express bus system capacity and service is limited by the size of the bus vehicles which must still be able to navigate streets, the passenger boarding time, and the road traffic. That is to say, rapidity of bus service operating in exclusive lanes adjacent to the sidewalks is influenced by the length of the vehicle, the control of fare collection with respect to passengers boarding the system, as well as motor vehicle traffic lights and the need to negotiate left turn movements, all of which increases a bus patron's trip time often in crowded conditions.

Traditionally, higher capacity rapid transit has been served by urban rail systems separated from road traffic. These rail rapid transit lines, on routes from the suburbs to the downtown, need to be constructed in an existing railroad right-of-way, or on a wide street with a treed boulevard in the middle. Generally these rail lines need to be built on wide parcels of low-priced land often away from the households of regular public transit users. In the downtown, core the line is usually constructed underground as the public streets are occupied by motor vehicles and privately owned land is too expensive to acquire for an elevated track right-of-way and stations.

Highly used fixed bus routes are found on arterial streets in densely populated areas of the city where land is expensive. Therefore, there is a need to develop an efficient high capacity rapid bus system that can be built in a city street to replace a heavily used fixed route bus service operating in road traffic. This will be a useful tool for the urban transit industry to reduce traffic congestion on arterial streets, air pollution and energy consumption in populated urban centers by attracting commuters that will leave their private vehicles at home for work trips on a high capacity comfortable rapid bus service.

Attempts have been made to increase the capacity of public transit service running on city streets by increasing the frequency between vehicles and the size of the vehicles. In the past, when crowded streetcars were running bumper to bumper, usually in the downtown, a city had the customer base to justify building a subway system. The other option of replacing crowded bumper to bumper streetcars with elevated trains became problematic as access to the elevated station platforms required expensive private property and complex designs for the station house to control entry to the system as well as stairs, escalators, and handicap elevators to reach the train.

Applicant is aware of the following patents that are directed to devices and systems useful in mass transportation of people in cities.

U.S. Pat. No. 3,457,876 to Holden discloses a railway system in which the cars are suspended below an elevated rail or rails and lowered to ground level to unload and load passengers.

U.S. Pat. No. 3,861,315 to Rypinski discloses an elevated trackway and support structure along a railroad right of way with a traction system having cables that drop down to pick up vehicles such as a car, truck or bus, and elevates them into a train of vehicles for transport along the trackway.

U.S. Pat. No. 3,890,904 to Edwards discloses a railway system where the cars travel on rails mounted on the side of a support beam that has the trackway and cars in the same horizontal plane. The system further discloses a special station feature based on the provision of an elevator in the car.

U.S. Pat. No. 4,394,837 to Edwards discloses an elevated railway system (as noted in U.S. Pat. No. 3,890,904 above) with elevators at each of the doors of the rail car in the stationhouse permitting passengers on the ground level station platform egress and ingress to the rail car.

U.S. Pat. No. 4,690,064 to Owen discloses an elevated side-mounted monorail transportation system with a conventional station building having side platforms for passenger unloading and loading.

U.S. Pat. No. 5,372,072 to Hamy discloses a transportation system moving passengers along a guide beam in both the horizontal and vertical plane.

U.S. Pat. No. 5,456,183 to Geldbaugh discloses an elevated structural beam trackway incorporating a side mounted passenger vehicle for traveling along the median strip of existing expressway infrastructure above the roadway traffic with conventional stationhouse and station platforms.

SUMMARY OF THE INVENTION

The present invention provides an efficient configuration of urban rapid transit components that overcomes the capacity limitation of a fixed route public bus service operating in dedicated lanes in road traffic. The elevated rail and monorail systems of prior art do not solve the problems of constructing the trackway and elevated passenger loading platforms in a city street without impacting private property by the proximity of the transit vehicle to a building facade or having to acquire private property to access said platforms.

Accordingly, the present invention provides an elevated transit system comprising:

an elevated guideway positioned above ground level, the elevated guideway defining a travel route;

an elevated bus for carrying passengers movable along the guideway; and a passenger lift station for moving passengers between a lower level and the elevated bus, the lift station having a movable platform movable between a lowered position to allow passengers access from the lower level directly to the movable platform and a raised position to allow passengers access to the elevated bus directly from the movable platform.

The present invention enjoys many useful advantages over existing low capacity rapid bus systems and intermediate capacity, light rail, rapid transit systems. The system's uniqueness is best characterized by its ability to follow the same route as a surface bus from the suburbs to the downtown and back, yet carry considerably more passengers per hour with less trip time than a road bound rapid bus system. Furthermore, the invention can carry the same hourly capacity as a light rail system separated from road traffic, without requiring a dedicated right-of-way, highway type thoroughfare, or existing railroad right-of-way for track structures, passenger platforms, and stationhouse as this invention is designed to be built in the motor vehicle lane of a typical four, six, or more lane road.

In a preferred embodiment, the high capacity elevated rapid bus of the present invention travels above utilities such as traffic signals, electrical wires, and streetlights three to four storeys above the road traffic. The infrastructure supporting the passenger vehicles and housing the movable platforms for passenger loading and unloading are erected in the parking or dedicated bus lane adjacent to the city sidewalk. The advantage of this configuration is that the high capacity elevated rapid bus route can be constructed along an existing bus route as opposed to a route convenient to the construction of conventional elevated rail rapid transit infrastructure. Furthermore, the high capacity buses of the present invention travel in a counterclockwise route from one end of the fixed route to the other and back eliminating the time consuming switching of direction experienced with urban rail systems.

The main advantages of a high capacity elevated rapid bus system are: no right-of-way acquisition costs, no subway construction in the downtown core, no time consuming switching from inbound to outbound tracks in the end stations downtown which reduces passenger capacity, and no paralleling of existing bus routes with a rail rapid transit line on a dedicated right-of-way which often occurs because it is difficult politically to remove an established public transit fixed route service even though the new rapid transit line may be only a few blocks away.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
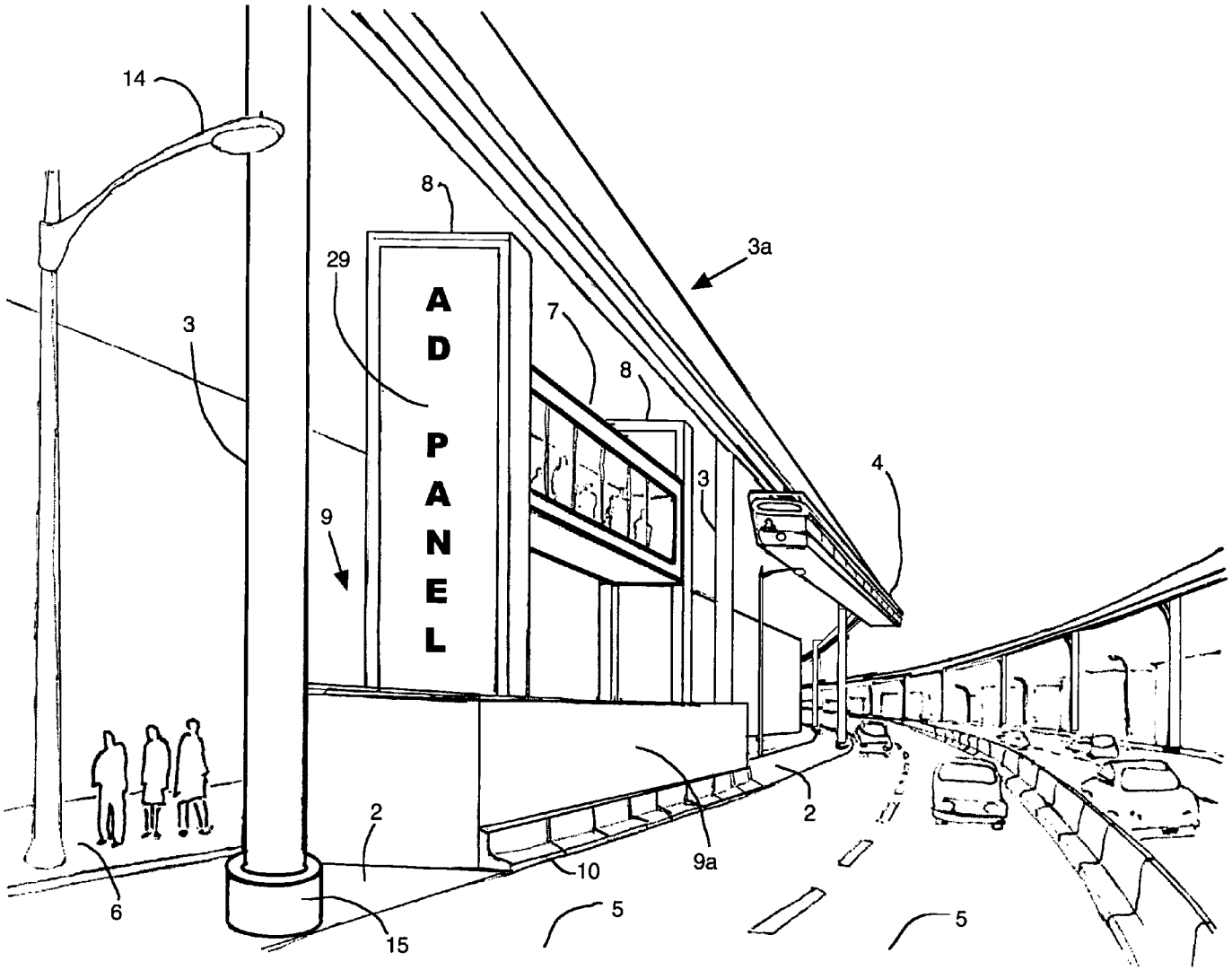
FIG. 1 is a perspective showing an embodiment of the elevated rapid bus system of the present invention including such features as structural supports, a lift station and enclosed movable platform built in the motor vehicle lane adjacent to the sidewalk of a typical city street.

Referring to FIG. 1, there is shown a preferred embodiment of the high capacity elevated rapid bus system according to the present invention useful in increasing the hourly passenger capacity and decreasing the passenger trip time of a public transit bus route. The bus system is positioned in an existing motor vehicle road lane, preferably curb lane 2, which is often already dedicated to parking and/or used as a priority bus lane of a city street. Curb lane 2 is used to anchor support structures 3 in the form of a plurality of space support columns that suspend an elevated guideway 3*a* above the level of the street in a cantilevered configuration. An elevated bus 4 for carrying passengers is movable along the elevated guideway 3*a* above a road lane 5 on which normal vehicular traffic moves. Elevated bus 4 is shown suspended beneath elevated guideway 3*a* in FIG. 1, and is preferably suspended over the road traffic lane 5 adjacent to the parking and/or curb lane 2 next to the public sidewalk. It will be apparent to those skilled in the art that other configurations of elevated guideway 3*a* and elevated bus 4 are possible in which the guideway 3*a* cantilevers the elevated bus over the road traffic lanes 5.

In the illustrated embodiment, passengers are transferred from ground or street sidewalk level 6 to the level of the suspended bus 4 at passenger lift stations 9 that define bus stops. Passenger lift stations 9 are also preferably located in the curb lane 2. Each passengers lift station 9 includes a movable platform 7 that moves between a lowered position at sidewalk level 6 to a raised position at the level of elevated bus 4. The movable platform 7 is preferably enclosed for the safety and protection of the passengers using sidewalls and a roof constructed above the platform, which defines the floor of the enclosure. The movable platform allows passengers to access the elevated bus directly from the platform. In the illustrated embodiment, movement of the movable platform 7 is guided by end supports 8. Conventional freight elevator technology such as hydraulic, pneumatic or winch and pulley system or other arrangements can be used to raise and lower platform 7.

At street level, movable platform 7 is dockable within a fixed ground level portion 9*a* of lift station 9 constructed in curb lane 2 in the region between adjacent support columns 3. Fixed ground level portion 9*a* receives and houses movable platform 7 when the platform is lowered to street level. Preferably, traffic safety barriers 10 are positioned adjacent the fixed ground level portion 9*a* to protect lift station 9 from road traffic. Outdoor advertisement panels 29 can be attached to the end supports 8 to generate revenue for the bus company.

While the illustrated embodiment shows movable platform 7 traveling between a street level lowered position and a bus level raised position, it will be appreciated that the lowered position of platform 7 may be at some level other than street level. For example, lift station 9 may be located below street level at an underground facility such as a shopping mall or parking lot in which case the movable platform may move from a lower level below ground to the elevated bus via an opening in the curb lane at street level.

As the elevated bus 4 is suspended above the traffic lanes 5, the width of the passenger cabin may be increased by 30% over a conventional city bus because the width of the elevated bus 4 is not restricted to the width of the standard urban traffic lanes 5. Furthermore, the length of the elevated bus 4 can be 50% longer than the standard two-cabin articulated public transit bus because fare collection is processed when passengers enter the lift station 9. A wider and longer elevated bus 4 can have two thirds more of the passengers seated and carry three times the number of passengers as the largest public transit road surface buses presently in service on North American streets. In other words, the elevated bus system of the present invention provides a truly high capacity bus rapid transit that is not affected by road traffic while following the same fixed route as the regular public transit service.

Figure 2:
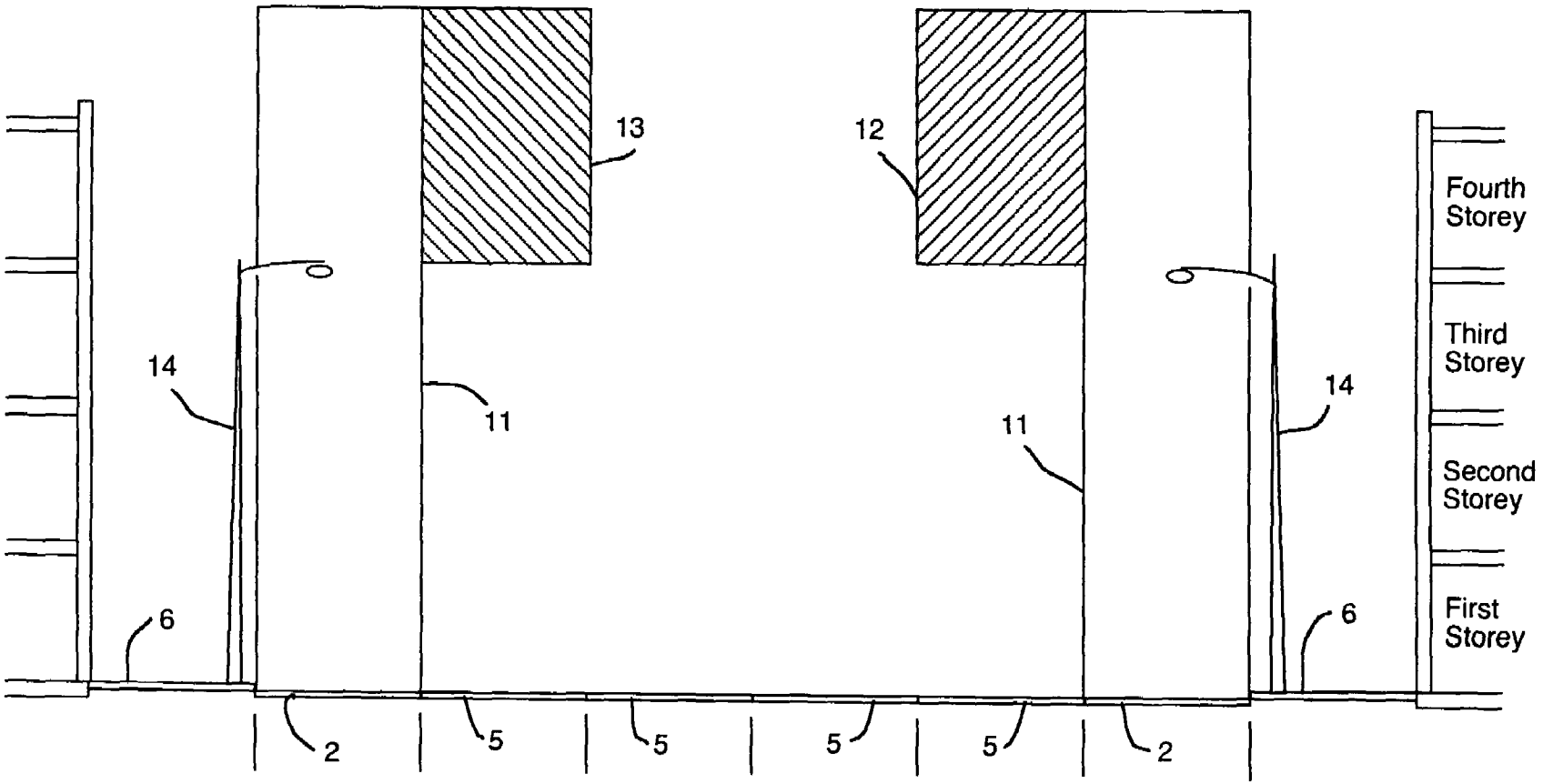
FIG. 2 is a schematic cross-section of a typical arterial road right-of-way feeding from the suburbs to the city downtown core where a major bus route would be located showing the zones that are occupied by the system of the present invention.

FIG. 2 is a schematic view of a typical arterial street in cross-section showing where the elevated transit system of the present invention is preferably deployed. Conventional fixed route buses generally move in the curb lane 2. The elevated bus system of the present invention relies on support columns 3 that occupy a zone 11 within and above the curb lane 2 adjacent to sidewalk 6. Conventional vehicular traffic is free to move as usual in inner road lanes 5. The suspended buses of the system travel in zones 12, 13 preferably three to four storeys above the sidewalk level 6. This height is selected so that the travel zones 12 and 13 will tend to be located above existing streetlights 14 to avoid conflicting with the lighting of the roadway. On each side of the street, the elevated buses preferably travel in different directions to coincide with existing traffic flow at street level. For example, on the right hand side of the street in zone 12, elevated buses may travel toward the downtown area of a city while in zone 13 the buses may travel in the return direction looping from the downtown to the suburbs. While it is preferred that the elevated buses 4 will travel in the same direction as the traffic which they are suspended over, this is not mandatory.

Figure 3:
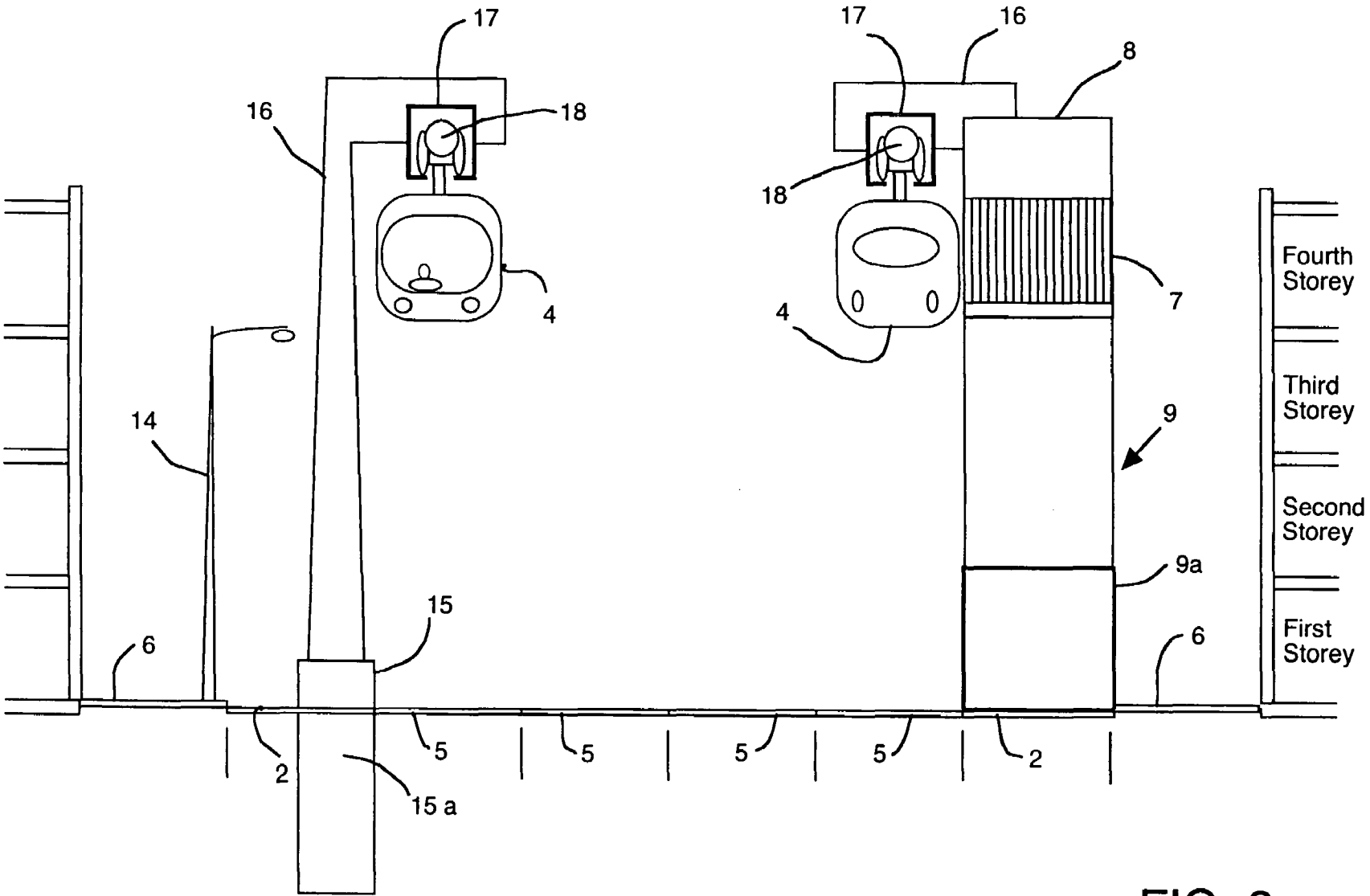
FIG. 3 is a schematic cross-section of a typical city street accommodating the high capacity elevated rapid bus system of the present invention in the motor vehicle lane by the city sidewalk.

FIG. 3 is another cross-sectional view of a street showing the elements of the elevated transit system of the present invention arranged on the streetscape and anchored in curb lane 2 adjacent to sidewalk 6. Support columns 3 located in the curb lane 2 preferably include a base portion 15 which is formed as an extension of a foundation 15*a* extending underground. Steel suspension poles 16 are attached to the base 15. The concrete base serves to protect the poles from motor vehicle traffic on road lanes 5. In a preferred arrangement, the suspension poles 16 cantilever steel guide beams 17 for suspension over road traffic lanes 5. Box shaped steel guide beams 17 form the elevated guideway 3*a* on which the elevated buses 4 run. The box shaped beams house and guide the vehicle propulsion and suspension system 18 attached to the passenger cabin of the elevated bus 4. Other arrangements of the elevated guideway 3*a* and the vehicle propulsion and suspension system 18 are possible, the illustrated system being described merely by way of example. The enclosed movable platform 7 transfers passengers from the sidewalk level 6 to the floor of the elevated bus 4 at the passenger lift stations 9.

Figure 4:
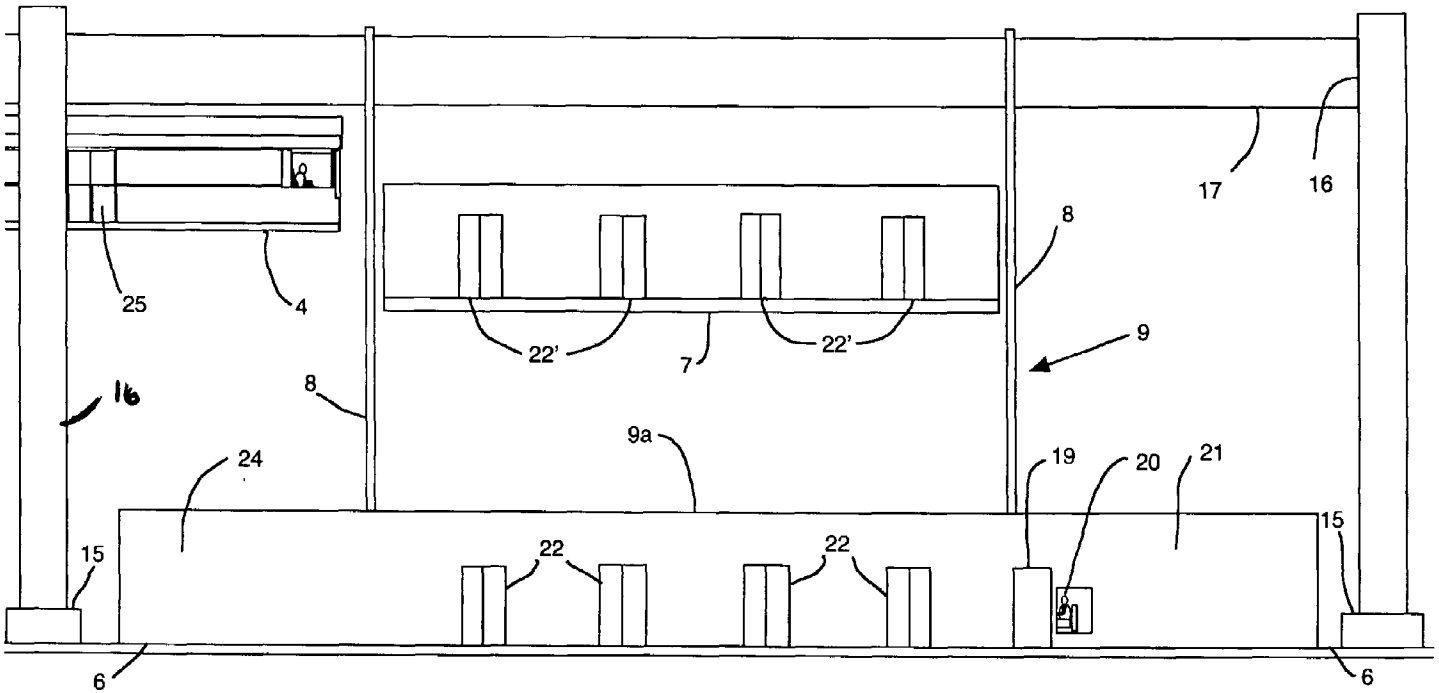
FIG. 4 is an elevation view from the sidewalk level of a bus stop passenger lift station according to the present invention showing the support structure span and the enclosed movable platform for transporting passengers between the street level and the elevated bus.

FIG. 4 provides a detail view of the lift station 9 in elevation from the level and direction of sidewalk 6. The lift station 9 is preferably located in the space between base portions 15 of support columns 3. In FIG. 4, movable platform 7 is shown traveling between the fixed ground level portion 9*a* of lift station 9 and elevated bus 4 that is pulling into the stop. Passengers enter the lift station 9 through a control door 19 where an operator 20 collects fares. When movable platform 7 is not at the lowered position, arriving passenger are temporarily held in the control room 21. A power source room 24 is present within lift station to house equipment for powering the components of the system. For example, if elevated buses 4 operate on electrical power, power source room 24 would house power transformers for the propulsion power and an emergency power supply to operate the elevated buses 4 and movable platforms 7 to get passengers safely off the system in the event of a power failure.

Figure 5:
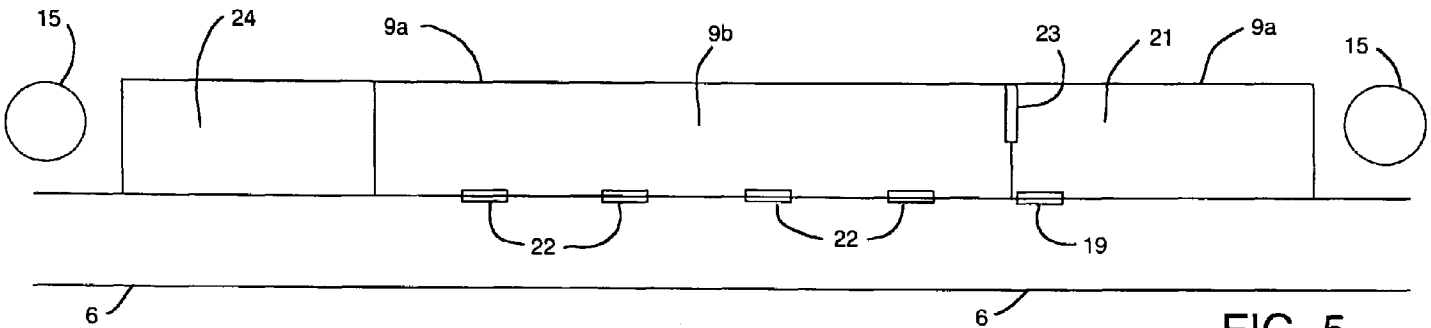
FIG. 5 is a plan view of the movable platform including entrance and exit doors.

A typical timing cycle for movable platform 7 is 60 to 90 seconds: ten seconds to rise meet the elevated rapid bus 4, twenty to thirty seconds to unload and load the bus from the platform, ten seconds to descend to sidewalk level 6, then ten to twenty seconds to unload exiting passengers through doors 22 and 22', followed by loading of boarding passengers for the next bus through entry door 23 from control room 21 (See FIG. 5).

Normally, operator 20 will allow loading passengers to enter the enclosed movable platform 7, after it has been emptied of exiting passengers, to wait for the next approaching elevated bus 4. Preferably, control room 21 is equipped with a passenger monitoring system that notifies the operator 20 if the next approaching bus is full and is only stopping to let passengers off. In which case passengers for boarding are held in the control room or on sidewalk 6 for the next elevated bus. Busy stops in the heart of the downtown may require two lift stations 9, one for passengers exiting the system, and, in an adjacent space, another lift station for passengers boarding the system. The off loading lift station for exiting passengers does not necessarily require control room 21. Off loading lift stations can be added to the elevated bus system, as necessary, after initial construction to accommodate an increase in transit rides at busy locations.

FIG. 5 shows the fixed ground level portion 9*a* of the lift station in plan view with control room entry door 19 and exit doors 22 facing sidewalk 6. A central cavity 9*b* is provided to house and received enclosed movable platform 7 when the platform is in the lowered position. Entry door 23 connects control room 21 with cavity 9*b* and the movable platform when the movable platform is in position within the cavity.

Figure 6:
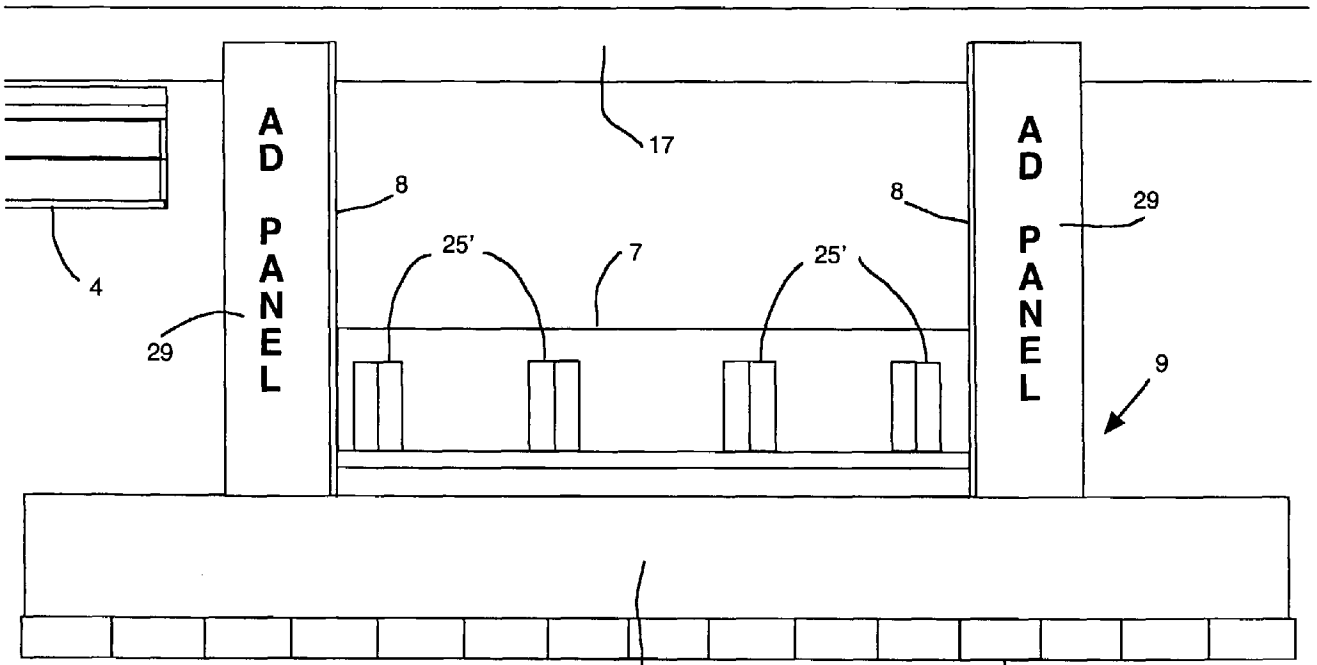
FIG. 6 is an elevation view from the road of a lift station and movable platform for lifting passengers.

FIG. 6 shows an elevation view of lift station 9 from the traffic lanes 5 of the road with enclosed movable platform 7 descending after offloading and loading passengers on the elevated bus 4, which is shown leaving the station. On this side of the movable platform, there are doors 25' for access directly to elevated bus 4 as will be explained in more detail below. Traffic protection barriers 10 protect the side of the lift station 9 facing traffic. FIG. 6 also shows the manner in which guides 8 for controlling the movement of platform 7 can be fitted with advertising on outdoor advertisement panels 29 for display to traffic traveling on the road.

Figure 7:
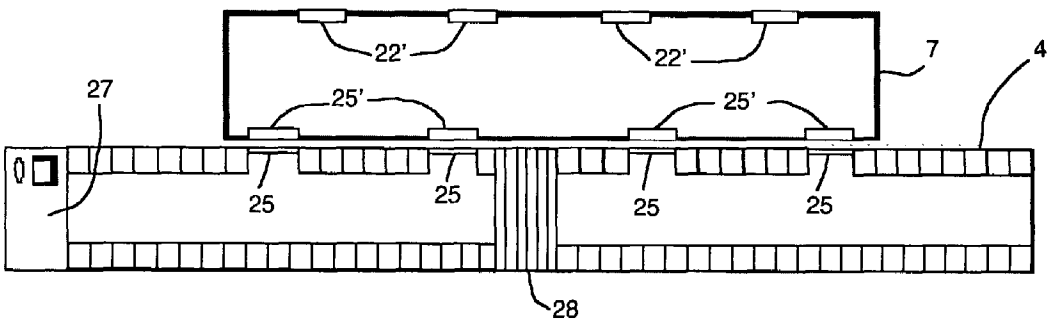
FIG. 7 is a plan view of the floor, doors, and typical seating of the suspended bus and the movable platform and door interface when the movable platform is moved to the raised position adjacent the elevated bus for loading and unloading of passengers.

FIG. 7 is a detail plan view of elevated bus 4 and movable platform 7 showing the manner in which the two components interface and co-operate to permit efficient loading and unloading of passengers. Movable platform 7 includes doors 25' which align with doors 25 in elevated bus 4 to permit passengers to load onto or unload from bus 4. Doors 25' are opposite doors 22' on the movable platform 7 which align with doors 22 in the fixed ground level portion 9*a* of lift station 9 to allow passengers to exit to the street at the sidewalk level. In the illustrated example, four set of alignable doors 25 and 25' are spaced apart for optimal offloading/loading of the elevated bus. Other arrangements of the doors are possible depending on the length dimensions of the elevated bus. In addition, FIG. 7 shows an exemplary location for an operator cab 27 and shows articulation member 28 that allows the elevated bus 4 to make right angle turn above the traffic lanes 5 (shown in FIGS. 1–3) and proceed on another street, as is the case with a conventional bus operating in road traffic.

Figure 8:
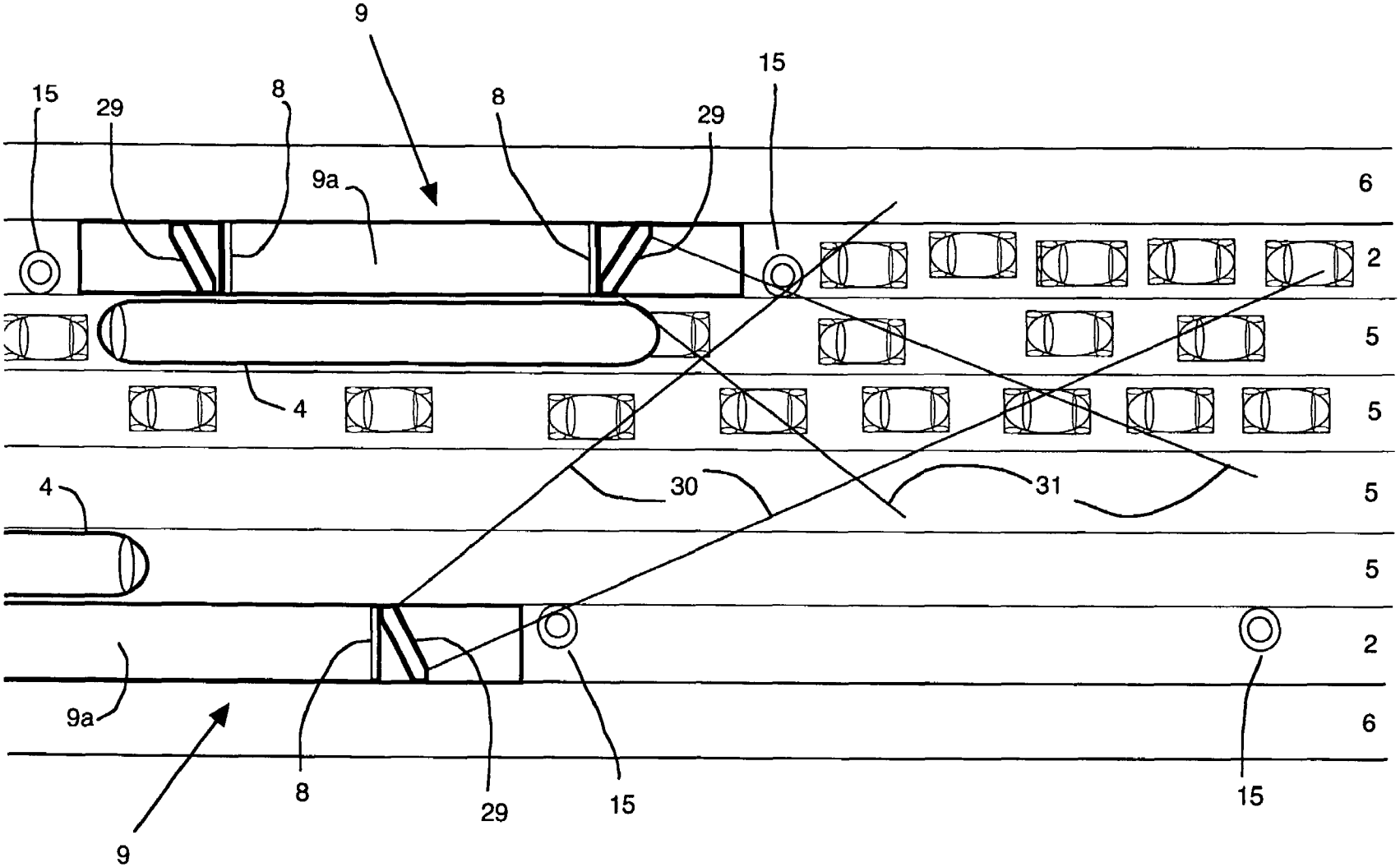
FIG. 8 is a schematic view showing sight lines of road traffic with respect to orientation of outdoor advertising on the lift stops.

The passenger lift stations provide a useful opportunity for public transit to offset operating expenses by taking advantage of the visibility of these structures from the road traffic vantage point. The outdoor advertising business measures the value of a billboard site by the road traffic counts. The end supports 8 of lift stations 9 are in an ideal location for outdoor advertising on advertisement panels 29. Panels 29 may be simple billboard surfaces, electronically programmable screens or may make use of any other system for displaying advertising. FIG. 8 is a plan view of a street that includes the elevated transit system of the present invention on both sides of the street adjacent to sidewalks 6. The system occupies the curb lane 2 of the road. Advertisement panels 29 are mountable to end supports 8 for movable platform 7 at each lift station 9 at an angle to the street to maximize exposure of advertising to traffic in lanes 5 of the street. Site lines 30 and 31 show how advertisement panels 29 are readily viewable by oncoming traffic traveling on the street. Public parking between guideway support columns 15 in curb lane 2 would be permitted and/or the public sidewalk could be widened between spans not occupied by the passenger lift stations 9.

Figure 9:
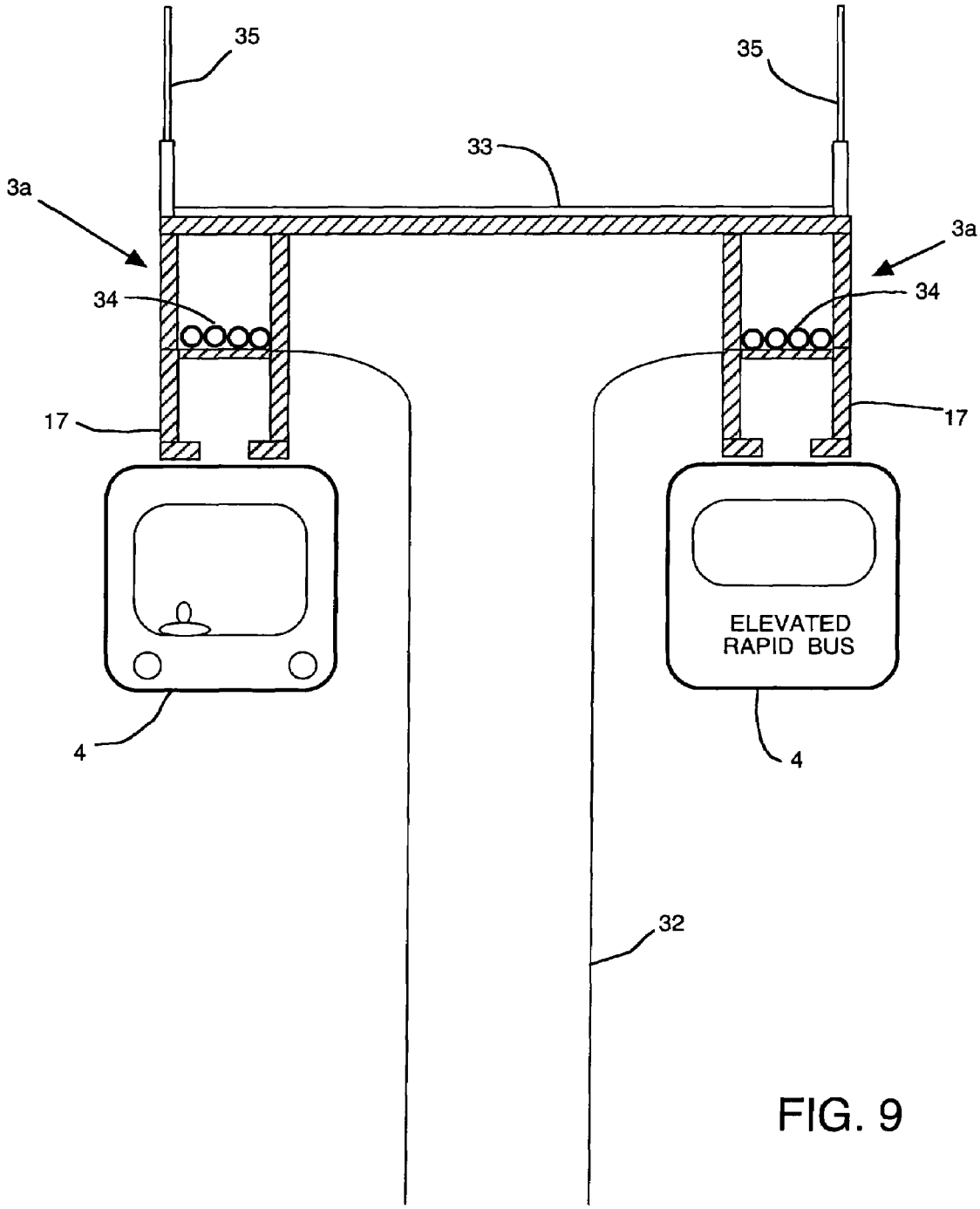
FIG. 9 is a detail view of a typical support structure for the system of the present invention employed when a street traverses a ravine, water-body, or other terrain where the city street becomes a bridge or tunnel.

FIG. 9 shows a preferred arrangement of guideway 3*a* for use with the elevated transit system of the present invention when a city street turns into a bridge or tunnel in order to cross a water-body, ravine or like geographical obstruction. In such cases, the elevated guideways 3*a* are configured to parallel the bridge or underground tunnel structure using a central support structure 32 capable of supporting two guide beams 17 side by side. In the case of a tunnel structure, the guideways 3*a* parallel the underground tunnel structure above ground. Guideways 3*a* from opposite sides of a street are tracked together on opposite sides of central support structure 32 across the obstruction to guide elevated buses 4 for travel in opposite directions. Support structure 32 can also provide a broad path surface 33 with safety barriers 35 atop the structure for pedestrian and cyclist traffic which is often not accommodated on bridges or in tunnels. As well, support structure 32 may provide a convenient conduit for routing of utilities 34.

While the elevated transit system of the present invention has been described primarily with respect to a transit system for use on existing city streets, it will be appreciated that the system finds application in any environment where it is necessary to move people from one location to another. For example, the elevated transit system can be used at an airport complex to move people between terminals or from terminals to satellite locations away from the terminals to reduce road congestion at the terminals. The inventive system can efficiently transport airline passengers and luggage carts to and from locations away from the terminal where they can connect with buses to hotels, city routes, charters, ferries and the like. The system can also connect to other stops such as private vehicle pick up and drop off zones, long term parking, and airport related industrial areas. In addition to reducing road congestion, the present system is able to handle luggage carts by virtue of the fact that passengers and their carts are able to move directly onto and off the movable platform when loading/unloading the elevated bus or exiting/entering the lift station. Conventional airport buses or light rail and monorail airport people movers are generally not able to accommodate luggage carts due to different passenger loading techniques for these systems.

As the elevated bus system of the present invention is preferably constructed and supported in the curb lane of a city street, there can be some efficiency in terms of construction of the structural fixed facilities in that certain major components such as the steel suspension poles supporting the guide beam are the same for every street, and can be fabricated in a plant and shipped to the site for erecting. As well, the lift stations and movable platform are the same for every site and would be made as a kit in a factory and shipped for assembly on site to avoid lengthy periods of traffic tie ups as may be experienced with onsite street construction.

A rail rapid transit lines requires special route engineering studies to determine where the track-way structures and stations can be built with the least amount of impact on the urban environment. The elevated transit system of the present invention is built on the fixed route with the most transit customers, where the most amount of the surface bus fleet would be deployed. As the elevated high capacity buses would replace the street buses, the redundant street buses could be deployed to other routes which would off set fleet acquisition costs to improve service in other areas of the city.

Although the present invention has been described in some detail by way of example for purposes of clarity and understanding, it will be apparent that certain changes and modifications may be practised within the scope of the appended claims.

I claim:

1. An elevated transit system comprising:

an elevated guideway positioned in a curb lane adjacent to a public sidewalk in a street, the elevated guideway defining a travel route;

an elevated bus for carrying passengers movable along the elevated guideway; and a passenger lift station for moving passengers between the public sidewalk and the elevated bus, the passenger lift station being positioned in the curb lane of the street adjacent to the public sidewalk, and the passenger lift station having a movable platform movable between a lowered position to allow passengers access from the public sidewalk to the movable platform and a raised position to allow passengers access to the elevated bus directly from the movable platform.

2. An elevated transit system as claimed in claim 1 in which the movable platform is an enclosed platform adapted for vertical movement between the lowered and raised positions.

3. An elevated transit system as claimed in claim 2 in which the passenger lift station further includes a fixed external structure at the lower level in which the movable platform is received and housed when in the lowered position.

4. An elevated transit system as claimed in claim 3 in which the external structure includes a fare collection station through which passengers pass prior to accessing the movable platform.

5. An elevated transit system as claimed in claim 3 in which the external structure is positioned below ground level.

6. An elevated transit system as claimed in claim 1 in which the elevated guideway is suspended above ground level by a plurality of spaced support columns.

7. An elevated transit system as claimed in claim 6 in which each support column includes a base positioned in the curb lane of the street adjacent to the public sidewalk.

8. An elevated transit system as claimed in claim 7 in which the passenger lift station is positioned between the spaced support columns.

9. An elevated transit system as claimed in claim 7 in which the support columns position the elevated guideway at a height such that the elevated bus travels above existing street lights and overhead wires.

10. An elevated transit system as claimed in claim 6 in which the elevated guideway comprises a plurality of guide beams extending between the spaced support columns and mounted to the columns in a cantilevered configuration to define the travel route along which the elevated bus travels.

11. An elevated transit system as claimed in claim 1 in which the movable platform is moved between the lowered and raised positions by an elevator system.

12. An elevated transit system as claimed in claim 11 in which the elevator system is controlled by an operating system selected from the group consisting of a hydraulic system, a pneumatic system, and a winch and pulley system.

13. An elevated transit system as claimed in claim 1 in which the elevated guideway is supported above ground level by a central support structure that supports at least two guideways.

14. An elevated transit system as claimed in claim 13 in which the central support structure includes an upper surface defining an elevated travel path.

15. The elevated transit system as claimed in claim 1 further including a passenger monitoring system for measuring the passenger payload on the elevated buses to control the pre-boarding of passengers into the lift station.

* * * * *